US010821322B2

(12) United States Patent
Škaroupka et al.

(10) Patent No.: US 10,821,322 B2
(45) Date of Patent: Nov. 3, 2020

(54) FITNESS EQUIPMENT

(71) Applicant: University of Technology Brno, Brno (CZ)

(72) Inventors: David Škaroupka, Brno-Ponava (CZ); David Paloušek, Brno-Žabovřesky (CZ)

(73) Assignee: UNIVERSITY OF TECHNOLOGY BRNO, Brno (CZ)

( * ) Notice: Subject to any disclaimer, the term of this patent is extended or adjusted under 35 U.S.C. 154(b) by 66 days.

(21) Appl. No.: 16/114,970

(22) Filed: Aug. 28, 2018

(65) Prior Publication Data

US 2020/0023233 A1 Jan. 23, 2020

(30) Foreign Application Priority Data

Jul. 18, 2018 (DE) ..... 10 2018 117 348

(51) Int. Cl.
*A63B 23/02* (2006.01)
*A63B 22/20* (2006.01)

(52) U.S. Cl.
CPC ..... *A63B 23/0211* (2013.01); *A63B 22/20* (2013.01)

(58) Field of Classification Search
CPC ..... A63B 23/0211; A63B 22/20; A63B 21/00185; A63B 23/0205; A63B 22/203; A63B 21/153; A63B 21/045; A63B 21/023; A63B 21/0004; A63B 2208/0219
See application file for complete search history.

(56) References Cited

U.S. PATENT DOCUMENTS 3,298,687 A * 1/1967 Douglas ..... A63B 21/154 482/132
3,403,906 A 10/1968 Burzenski
3,752,475 A * 8/1973 Ott ..... A63B 21/0004 482/127
5,499,961 A * 3/1996 Mattox ..... A63B 21/055 482/123
6,638,201 B1 * 10/2003 Dischler ..... A63B 22/20 482/132
7,175,573 B1 * 2/2007 Huang ..... A63B 21/0004 446/236
8,894,555 B2 * 11/2014 Colledge ..... A63B 21/0004 482/132
9,011,303 B2 4/2015 MacColl et al.
9,415,258 B1 * 8/2016 Higgins ..... A63B 21/068
(Continued)

FOREIGN PATENT DOCUMENTS

EP 2651523 A2 10/2013

*Primary Examiner* — Andrew S Lo
(74) *Attorney, Agent, or Firm* — Blank Rome LLP

(57) ABSTRACT

The invention relates to a fitness device consisting of a cylindrical body in which the handles are mounted horizontally against each other. The body consists of two coaxial rings, inner ring and outer ring, which are positioned in a reciprocally sliding or rolling relation, the inner ring on its inner surface is equipped with a housing for holding the handles; the axis of the handle being at a height, which is less than ½ of the outer diameter of the body at the place of the housing of the location of handles from the outer surface of the outer ring; and the handles are bent upwards. The connection between the handles and the handle-holding case is dismountable and the outer surface of the outer ring is provided with a rubber surface.

14 Claims, 2 Drawing Sheets

(56) References Cited

U.S. PATENT DOCUMENTS

| | | | | |
|---|---|---|---|---|
| 2003/0158023 | A1* | 8/2003 | Yu | A63B 21/0004 482/126 |
| 2011/0183824 | A1* | 7/2011 | Yang | A63B 21/0004 482/132 |
| 2012/0157274 | A1 | 6/2012 | MacColl et al. | |
| 2012/0264578 | A1* | 10/2012 | Frederick | A63B 21/0004 482/132 |
| 2016/0101314 | A1* | 4/2016 | Exley | A63B 22/20 482/132 |
| 2017/0080271 | A1* | 3/2017 | Miller | A63B 21/00 |
| 2017/0173382 | A1* | 6/2017 | Stevens | A63B 22/20 |
| 2019/0030391 | A1* | 1/2019 | Chuang | A63B 5/20 |
| 2019/0134447 | A1* | 5/2019 | Chiang | A63B 21/0004 |

* cited by examiner

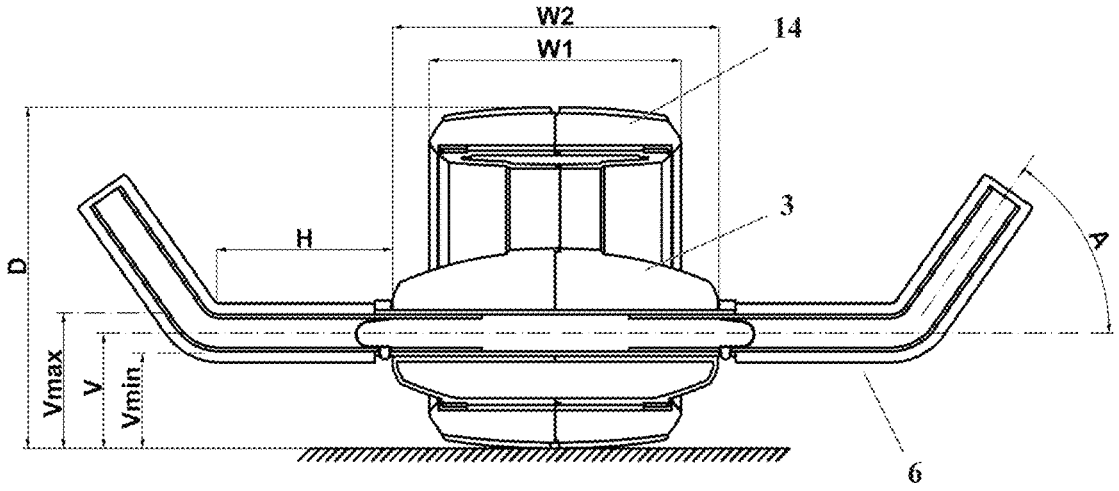
Fig. 3
Fig. 4A
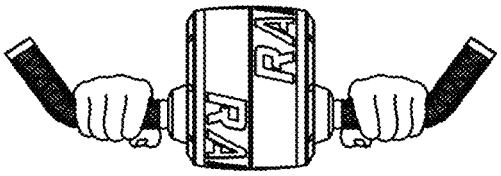
Fig. 4B
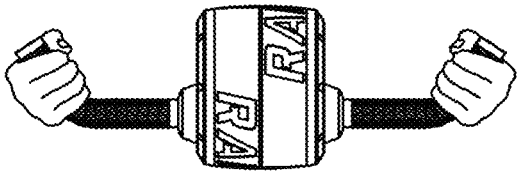
Fig. 4C
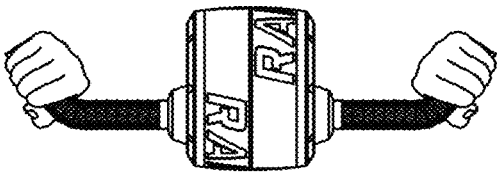

FITNESS EQUIPMENT

CROSS-REFERENCE TO RELATED APPLICATION

This application claims priority to German Application No. 10 2018 117 348.2 filed on Jul. 18, 2018, which is hereby incorporated herein by reference in its entirety.

FIELD OF THE INVENTION

The present invention relates to a fitness device of a cylindrical shape with handles, which serves to strengthen the abdominal muscles and the associated muscle parts.

BACKGROUND OF THE INVENTION

Resistance fitness exercise devices enable the user to strengthen by putting up resistance to the movement of the user's arms, legs or trunk. Resistance is usually induced by one muscle working against another muscle or against the force of gravity.

U.S. Pat. No. 3,403,906 discloses an exercise device in the form of at least one wheel or, for example, two rotating wheels at a certain distance from each other, placed on a shaft that passes through their centre. The ends of the shaft are provided with extensible handles extending the length of the grip, shaped for gripping by the fingers. However, the device does not allow you to set the device resistance.

U.S. Pat. No. 9,011,303 discloses a fitness device the body of which comprises a case of a circular cross-section, consisting of two halves connected in a vertical plane. The handle passes the centre of the body in the horizontal plane; its ends are outside the body and curved downwards at a certain angle. A coil spring element can be found close to the central axis of the case, providing resistance to the rotation of the wheel while moving on the mat and facilitating the movement of the wheel to the starting position during exercise.

EP2651523 discloses a fitness device comprising two mutually connected coaxial wheels with a flat centre through which a handle passes, the ends of which are bent downwards.

For strengthening abdominal muscles and related muscle parts in gyms and in home conditions, devices are currently available in the market that consist of mostly one or two rotating wheels of different widths and with a fixed centre, mounted on a shaft that passes through their axis. The wheels are mounted in the centre of the shaft or at each end of the shaft. The surface of the wheels is usually made of plastic or rubber, and the shaft is provided at the end with handles that may be differently shaped or curved downwards with respect to the axis of the shaft. The person holds the handles of the fitness device on both sides and performs the rolling motion of the wheel on the mat in the direction from himself/herself and back. Some devices are provided with a spring that puts up resistance to the rotation of the wheel moving along the mat in the direction from the body and facilitates the movement of the wheel to the starting position during exercise.

For proper ergonomics of exercise, it is advisable to place the handles as close as possible to the mat. However, the lowering of the grip in the conventional fitness wheel design results in a reduction in the wheel diameter and thus in the increase of rolling resistance and contact pressure on the mat. Increasing rolling resistance can make exercise more difficult and the bigger contact pressure puts more weight on the mat and increases the risk of its damage if its surface is not adjusted for such exercise.

BRIEF SUMMARY OF THE INVENTION

The above drawbacks of existing devices for strengthening abdominal muscles and related muscle parts are solved by the fitness device according to the invention, which is designed to allow exercise stability due to the lower location of the handles and at the same time allow the use of a suitable diameter of the wheel while reducing the rolling resistance and the contact pressure.

The subject of the invention is a fitness device comprising a cylindrical body provided with handles. The cylindrical body consists of two coaxial rings, an inner ring and an outer ring, which are positioned in a reciprocally sliding or rolling relation. The outer surface of the outer ring is provided with a rubber surface that can be textured.

Under the horizontal plane, in which the longitudinal axis of the device body lies, the inner ring on its inner surface is equipped with a case for holding the handles. The handles are of a circular cross-section and in the handle case are positioned horizontally against each other. The axis of the handles is at a height which is always less than ½ of the outer diameter at the place of the handle-holding case from the outer surface of the outer ring, i.e. from the mat, ideally in the range of 52 mm to 74 mm from the mat, preferable at a height of 63 mm. The ends of the handles are bent upwards relative to their longitudinal axis at an exterior angle of 90° at most, preferable at an angle of 55°. The length of the horizontal part of the handle from the handle-holding case is at least 96 mm. The connection between the handles and the handle-holding case is dismountable. The surface of the handles may be provided with a rubber surface, preferably textured.

The fitness device is designed to allow stable, ergonomically correct exercise and smooth movement when moving along the exercise mat due to the lowered placement of the handles to the required height that does not depend on the diameter of the cylindrical body of the fitness device. It is thus possible to place the handles low while maintaining optimum rolling resistance since the diameter of the fitness device body can be greater than it would have to be if its rolling axis was identical to the axis of the handles.

The centre of gravity of the handle-holding case is as low as possible relative to the exercise mat. The handles are more stable and do not bend under the weight of an exercising person. The position of the body is as close as possible to the natural posture in the position with the hands on the ground, and the muscles are effectively stretched to the maximum during the exercise. A safe grip guarantees safe and effective exercise. The mechanical design of the rotation of the fitness devise based on the sliding placement puts up resistance in direct proportion to the weight of the exercising person. This means that excessive load or ineffective free rotation of the rings is avoided.

The shape of the handles allows the grip of the device by the horizontal part or by the bent part and the alternation of these two ways of gripping. This allows you to strengthen various muscles. It extends the number of exercise positions and improves exercise ergonomics. The handle surface is preferably not ergonomically shaped or curved in any direction. In this case, the user of the device faces no risk of straining or damaging the wrist due to different shapes of hands and palms. The device has removable handles that can be stored, for example, in the fitness device, minimizing the storage space and facilitating the transportation of the device.

The surface of the outer ring of the fitness device, which comes in direct contact with the mat on which the exercise is performed, is made of rubber, preferably thermo-plasticized rubber TPR with good adhesion to the surface. This contributes to stable movement during the exercise. The surface of the outer ring is at the same time abrasion resistant and does not leave marks on the mat on which the exercise is performed. Preferably, this surface is provided with a pressed pattern. The fitness device can be used on a smooth surface, such as a carpet, as well as on a mat.

BRIEF DESCRIPTION OF THE DRAWINGS

FIG. 3 is a drawing of a vertical section of the fitness device;

FIG. 4*a*) is a drawing showing the gripping of the fitness device by horizontal part of handles;

FIG. 4*b*) is a drawing showing gripping of the fitness device by bent part of handles with backs of hands away from themselves; and FIG. 4*c*) is a drawing showing gripping of the fitness device by bent part of handles with backs of hands facing each other.

DETAILED DESCRIPTION OF THE INVENTION

Figure 1:
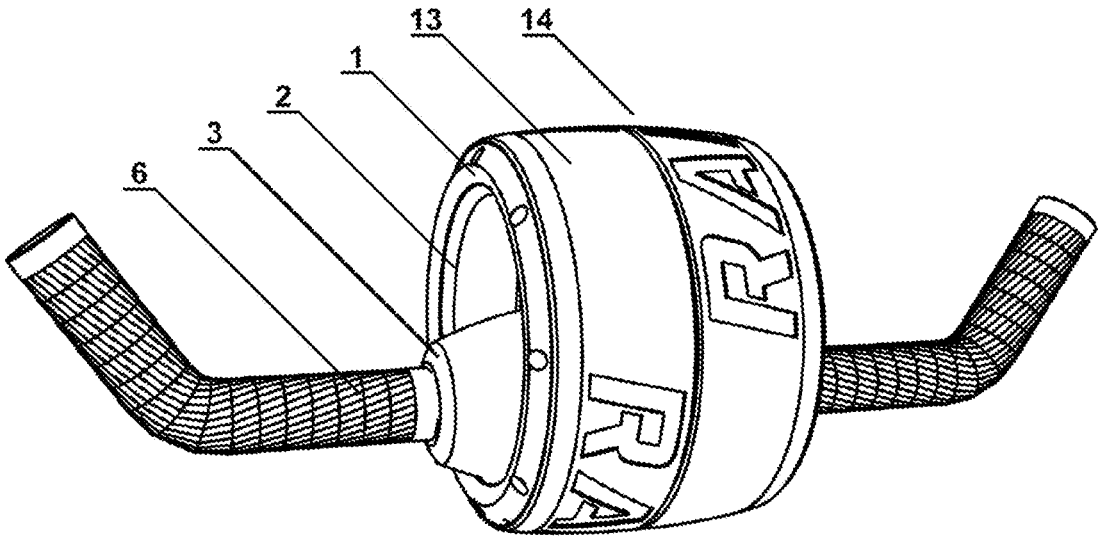
FIG. 1 is a diagram of the fitness device and its main parts.
Figure 2:
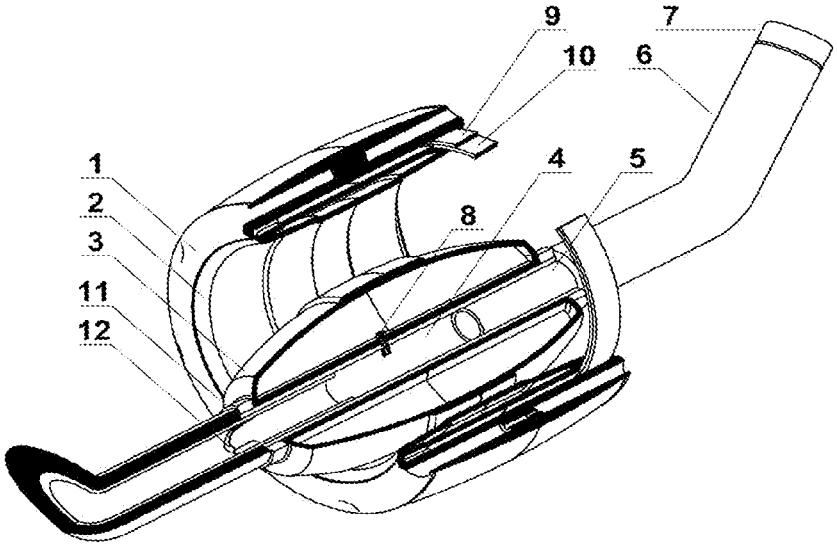
FIG. 2 is a drawing of a section of the fitness device in oblique view of the inner part with mounting of handles and sliding placement of outer and inner ring.

The fitness device includes a hollow body 14 of a cylindrical shape with an outer diameter of 186 mm, which is rounded towards the edges. In body 14 of the fitness device, handles 6 are placed horizontally against each other, projecting into the outer space (FIG. 1). Body 14 of the fitness device has two coaxial rings, inner ring 2 and outer ring 1, positioned in a reciprocally sliding relation, which includes outer sliding case and inner sliding case (FIG. 2). The body 14 has a minimum width of 100 mm. Width of body 14 is 137 mm, for example. On the inner surface of inner ring 2, a housing is mounted of handle-holding case 3, which extends longitudinally beyond the edges of body of the fitness device and has length of 178 mm (FIG. 3).

Handles 6 are of a circular cross section and are mounted in housing by means of steel tube structure fitted along the longitudinal axis of hollow housing placed in tubular sleeve, equipped with safety pin of the tubular structure, which connects housing of the case 3 holding handles 6 with tubular sleeve. The two rings and are made of plastics; inner ring together with housing of the case holding handles constitute one casting. At the ends of housing, tubular sleeve is surrounded by spacing rings on the outer side. As best seen in FIGS. 1 and 3, the axis of handles 6 is off-set or lower than the rolling axis of the body 14. The axis of handles 6 is at a height of 63 mm, for example, from the mat, i.e. from outer surface of outer ring 1 at the place where the housing is connected with inner ring 2 (FIG. 3).

Handles are bent upwards at the ends relative to the axis of handles at an external angle of 55°; a length of the horizontal portions of handles up to the bend is 96 mm (FIG. 3). Handles are connected to housing of the case holding handles on tubular sleeve by a cotter by means of spring located on the outside of housing of the mounting of handles under spacing rings. (FIG. 2) By means of the cotter, handles can be easily detached from body of the fitness device and possibly slid into its interior space for easier transport and storage of the device.

Outer surface of outer ring is provided with a textured surface of thermo-plasticized rubber (TPR). Handles are provided with a smooth rubber surface and the ends are equipped with plug.

The shape of handles allows the grip of the device by the horizontal part or by the bent part and to alternate these two ways of gripping (FIG. 4*a*)-*c*)). This allows you to strengthen various muscles.

INDUSTRIAL APPLICABILITY

The fitness device according to the invention serves to strengthen the abdominal muscles and related muscles. Placement of the axis of the handles under the longitudinal axis of the cylindrical body of the device as close as possible to the exercising mat and the design of the device rotation ensure smooth movement, stability of the handles, maximum and effective workouts and extended lifetime of the device. The shape of the handles makes it possible to strengthen various muscles, extends the number of exercise positions and improves the ergonomics of exercise. The device is easily portable and space-saving in terms of storage.

LIST OF REFERENCE NUMERALS

1—outer ring
2—inner ring
3—handle-holding case
4—tubular sleeve for holding the handles
5—tube structure of the handle
6—handle
7—handle plug
8—safety pin of the tube structure
9—outer sliding case
10—inner sliding case
11—spacing ring
12—spring
13—outer surface of outer ring
14—fitness equipment body
A—external angle of handle bend relative to its longitudinal axis
D—outer diameter of the fitness device body
H—length of the horizontal part of the handle
V—optimum height of the longitudinal axis of the handles relative to the mat
Vmin—minimum height of the longitudinal axis of the handles relative to the mat
Vmax—maximum height of the longitudinal axis of the handles relative to the mat
W1—width of the fitness device body
W2—length of the handle-holding case

The invention claimed is:

1. A fitness device, comprising:

a cylindrical body including handles that are mounted horizontally against each other, characterized in that the body includes, inner and outer coaxial rings which are positioned in a reciprocally sliding or rolling relation, wherein the body has a minimum width of 100 mm and an outer diameter;

the inner ring has an inner surface equipped with a housing for holding the handles, wherein the housing extends longitudinally beyond edges of the inner ring and outer ring, the handles are of a circular cross-section and are placed in the housing horizontally against each other, an axis of the handles being at a height which is less than ½ of the outer diameter of the body, the axis of the handles being located where the handles extend from the outer ring, and each of the handles has a horizontal grip part and a bent grip part, each bent grip part is bent upwards, at respective ends of the handles, relative to the axis of the handles at an external angle of less than 90°, a connection between the handles and the housing is dismountable and the outer surface of the outer ring is provided with a rubber surface.

2. The fitness device according to claim 1, characterized in that an outer surface of the outer ring is a rubber surface that is textured.

3. The fitness device according to claim 1, characterized in that the axis of the handles is located at a height of 63 mm from an outer surface of the outer ring.

4. The fitness device according to claim 1, characterized in that the handles are bent upwards at respective ends thereof relative to the axis of the handles at an external angle of 55°.

5. The fitness device according to claim 1, characterized in that a length of a horizontal part of the handles is at least 96 mm.

6. The fitness device according to claim 1, characterized in that a surface of the handles is made of rubber.

7. The fitness device according to claim 6, characterized in that the rubber surface of the handles is textured.

8. The fitness device according to claim 1, characterized in that the housing extends longitudinally beyond edges of the body.

9. A fitness device, comprising:

a cylindrical body defining a central rolling axis and an outer rolling surface, the body including inner and outer coaxial rings which are positioned in a reciprocally sliding or rolling relation;

a housing mounted to an inner surface of the inner ring of the body, wherein the housing extends longitudinally beyond edges of the inner ring and outer ring and handles mounted horizontally in the housing and extending outwardly therefrom, each handle having a horizontal grip part and a bent grip part, the horizontal grip parts defining an axis of the handles that is offset from the rolling axis of the body, each bent grip part being bent toward the rolling axis of the body with respect to the axis of the handles at an external angle of less than 90°.

10. The fitness device according to claim 9, characterized in that the axis of the handles is at a height which is less than ½ of an outer diameter of the body.

11. The fitness device according to claim 9, characterized in that the handles are removably mounted to the housing.

12. The fitness device according to claim 9, characterized in that the housing extends longitudinally beyond edges of the body.

13. The fitness device according to claim 9, characterized in that each handle has a circular cross-sectional shape.

14. The fitness device according to claim 9, characterized in that the outer surface of the body is a rubber surface.

* * * * *